US006820569B2

(12) United States Patent
Warfel et al.

(10) Patent No.: US 6,820,569 B2
(45) **Date of Patent: *Nov. 23, 2004**

(54) FOLDABLE FRAME FOR A BOAT COVER

(75) Inventors: Jeremiah S. Warfel, Elkhart, IN (US); Joseph L. Englehaupt, Warsaw, IN (US); Jerry L. Scott, Elkhart, IN (US); Bradley R. Fishburn, Nappanee, IN (US)

(73) Assignee: Bennington Marine LLC, Elkhart, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/751,696

(22) Filed: Jan. 5, 2004

(65) Prior Publication Data

US 2004/0134408 A1 Jul. 15, 2004

Related U.S. Application Data

(63) Continuation of application No. 10/194,675, filed on Jul. 12, 2002, now Pat. No. 6,672,241.

(51) Int. Cl.[7] ..... B63B 17/00
(52) U.S. Cl. ..... 114/361; 135/88.01
(58) Field of Search ..... 114/361, 364; 135/88.01, 88.02, 88.03, 88.04, 121, 122

(56) References Cited

U.S. PATENT DOCUMENTS 2,821,989 A * 2/1958 Harwood ..... 114/361
4,799,444 A * 1/1989 Lisowski ..... 114/221 R
5,303,667 A * 4/1994 Zirkelbach et al. ..... 114/361
5,413,063 A * 5/1995 King ..... 114/221 R
5,520,139 A * 5/1996 King et al. ..... 114/361
5,697,320 A * 12/1997 Murray ..... 114/361
5,904,114 A * 5/1999 Wright ..... 114/361
5,931,114 A * 8/1999 Bartholomew ..... 114/361
6,006,692 A * 12/1999 Szukhent, Jr. ..... 114/361
6,349,666 B1 * 2/2002 Hastings ..... 114/361

* cited by examiner

*Primary Examiner*—S. Joseph Morano
*Assistant Examiner*—Lars A. Olson
(74) *Attorney, Agent, or Firm*—Stevens & Showalter LLP

(57) ABSTRACT

A collapsible frame for a cloth or canvas-like top for a boat, having latching members which retain the collapsible frame to a plurality of mounting brackets secured to the boat frame. The latching members allow for the boat frame to be quickly orientated in either an open position, providing protection to the occupants of the boat, a closed position, used to store the frame on the boat when not in use, or a travel position, securing the boat cover frame in a manner sufficient to allow movement of the boat on a trailer. In changing the position of the frame, the latching member may be disconnected from the mounting brackets without the use of tools or removable parts that may be lost or misplaced. Additionally, the latching members include a pair of wings including retaining ridges which allow a latching of frame members to one another, securing frame members not in use during various configurations of the collapsible frame.

9 Claims, 17 Drawing Sheets

FOLDABLE FRAME FOR A BOAT COVER

CROSS REFERENCE TO RELATED APPLICATION

This application is a continuation of application Ser. No. 10/194,675, filed Jul. 12, 2002 now U.S. Pat. No. 6,672,241.

BACKGROUND OF THE INVENTION

1. Field of the Invention

The present invention relates to a collapsible frame including a cloth or a canvas-like top and fasteners for use with a watercraft. More particularly, the present invention pertains to a collapsible frame for a Bimini sun top in use on a pontoon boat.

2. Description of Prior Art

Collapsible boat frames including a canvas-like top protecting the occupants of the boat from inclement weather and providing shade from the sun are well known in the art. Often times, these frames are made from a light but strong material, such as aluminum, in order to add as little weight to the boat as possible, but still provide sufficient strength to ensure that the top does not buckle or collapse in strong winds or heavy seas. Typically, these frames are designed to be first retained in a closed position, providing very little to no cover over the occupants of the boat, while occupying very little deck or storage space. Generally, this is accomplished by supporting the frame along the sides of the boat. When protection is desired, the frame may be opened into a second position, stretching the canvas covering, over a substantial portion of the deck. Typically, these frames may also be arranged in a third position for long-term storage or land transport of the boat. This third position is a more secure location designed to reduce drag on the cover, thereby increasing the life of the canvas, and to ensure the cover is maintained at a height level below low tree branches and power lines, as the boat rolls upon the trailer.

One of the major limitations of the collapsible Bimini tops and frames known in the prior art is the inclusion of removable retaining members, which may be lost or misplaced when the collapsible frame is being moved from one of the above-described positions to another, or can simply be lost due to vibration as is common to fasteners. U.S. Pat. No. 5,706,752 granted to Menne, Jr., et al., discloses a Bimini Sun Top Frame for a Pontoon Boat. When in the open position, the frame disclosed therein is attached to the rails of the pontoon boat, in three different positions, by either stainless steel screws or bolts, which must be removed if the position of the frame is to change. These stainless steel pieces may be easily misplaced, or lost over the side of the boat becoming unrecoverable and thereby requiring replacement of the lost articles. Further, the use of screws and bolts require the use of tools, such as screw drivers, in order to free the frame from its connection to the deck rails, and allowing rearrangement.

U.S. Pat. No. 5,803,104 granted to Pollen discloses a Bimini Cover for a Deck of a Watercraft. This cover, when in the open position, is in contact with the frame rails of the pontoon boat in two positions. In order to rearrange the positioning, a pin must be removed and set aside and a spring/pin combination must be depressed. This represents a complicated means for changing the positioning of the cover, during which an opportunity for misplacement of the pin presents itself, thereby rendering the Bimini top useless until a replacement pin can be located.

Another known shortcoming to the existing covers is that when in the secured position for towing, the collapsed frame bounces during transport, and often times mars the covering, the seat covers on which it rests, or other articles are dented or scratched due to the vibrating frame.

SUMMARY OF THE INVENTION

It is an object of the invention to provide a more easily operable frame for a cover top of a boat or similar article. It is a further object of the present invention to employ a collapsible frame for use on a watercraft, which may be arranged in a storage position, a closed transport position, and an open position providing protection to the occupants of the watercraft. Further, rearrangement of the frame may be accomplished without need for removable parts, such as screws, bolts and the like.

It is another object of the invention to ensure that when arranged in the storage position, the frame and cover remain secure and do not bounce or damage either the side frame rails or the deck of the boat.

These and other objects of the invention are achieved by providing a Bimini top frame including latching members, thereby allowing the frame to be fixed to a bracket, permanently mounted to either the deck of the boat or the top frame rails of the pontoon boat. The latching members envelop smooth pins joined to the brackets with the raised lip portion of the latching member ensuring the latching members stay engaged with the pins, thereby securing the frame to the frame rails of the pontoon boat. These latching members may be disengaged from the bracket assembly through the application of a light force upon a lever arm causing movement of the raised lip. As such, rearrangement of the frame is accomplished without a need for tools or removable components.

The frame includes a plurality of ribs with grooves that complement a winged portion of the latching member. This winged portion of the latching member includes a pair of extended walls having ribs. These walls are flexible but also sufficiently resilient, such that this portion of the latching member may be joined with any portion of the frame having grooves on the surface. The wings of the latching member are able to flex a sufficient distance such that the ribs located on the inner surface of the walls snap into the grooves of the frame. Although the wings are sufficiently resilient ensuring the latching member will stay attached to the frame during normal use, the side walls of the latching member have adequate flexibility such that a normal lifting force applied by a user will disengage the latching member from the frame. Due to the use of these latching members, no removable pins, bolts, screws or the like are needed to employ the Bimini top of the present invention. This eliminates the requirement of employing tools to rearrange the top from one position to another and eliminates the possibility of misplacing removable components when switching the top from one position to another.

It is also an object of this invention to provide a Bimini top which rests above the frame rails during transport, ensuring the top does not come into contact with the frame rails and preventing damage to both the top and the frame rails. This is accomplished by including a smaller frame portion with two latching members having both the notched portion and the flexible wings. This smaller frame provides support to the frame when arranged in the storage position by latching onto a pin/bracket assembly attached to the frame rails above the deck so that the Bimini frame remains located just above the frame rails.

Further scope of the applicability of the present invention will become apparent from the detailed description contained herein. However, it should be understood that the detailed description and specific example, while indicating one embodiment of the invention, are given by way of illustration only, since various changes and modifications within the spirit and scope of the invention will become apparent to those skilled in the art, from this detailed description.

BRIEF DESCRIPTION OF THE DRAWINGS

These and other features of the invention will become more apparent and the present invention will be better understood upon consideration of the following description and the accompanying drawings wherein.

DETAILED DESCRIPTION OF THE EMBODIMENTS OF THE INVENTION

The embodiment of the invention described herein is not intended to be exhaustive, nor to limit the invention to the precise forms disclosed. Rather, the embodiment selected for description has been chosen to enable one skilled in the art to practice the invention.

Figure 1:
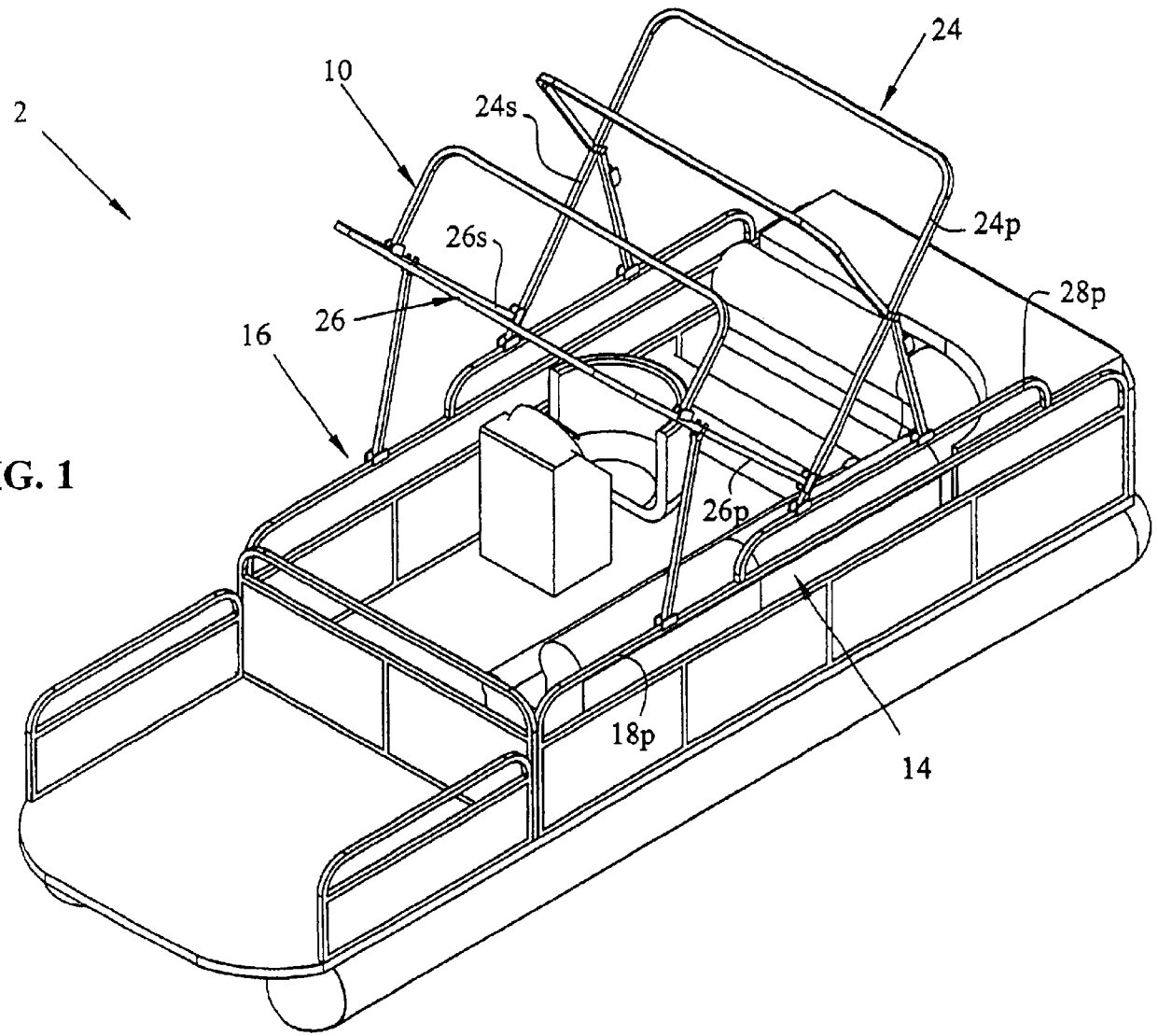
FIG. 1 is a perspective view of a boat including the collapsible boat frame of the present invention situated in the open position.

Referring in detail to the drawings and with particular reference to FIG. 1, a watercraft 2 is depicted, and in particular a pontoon boat, where the pontoon boat includes a collapsible frame 10 in an open position capable of supporting a cover (not shown) to shield a portion of a watercraft from above. The cover may be made from any type of material known in the art, such as a cloth or canvas. Additionally, it is generally preferred that the cover be resistant to water so as to protect boat occupants from inclement weather. Further, it is also desired that the cover be made from a material which does not greatly expand or contract in the presence of sunlight, as often these covers are employed by the occupants of the watercraft 2 to provide shade.

Displayed in FIG. 1 and throughout, the watercraft 2 is shown as a pontoon boat, having a port side frame generally indicated by numeral 14, and a starboard side frame generally indicated by numeral 16. Although a pontoon boat is displayed throughout the figures as the support for frame 10, it should be readily apparent to one possessing ordinary skill in the art that this frame may be adapted to any type of watercraft capable of providing an area sufficient to support the bracket assemblies described herein, such as a deck boat, a speed boat or a fishing boat. Although in the embodiment shown herein, the collapsible frame 10 mounts to the frame rails 14, 16 in a manner described below, it should be noted that the frame rails 14, 16 are not necessary to employ the collapsible frame 10 described herein, but rather, the frame may be mounted directly to either the deck portion or side frames of any boat.

Figure 2:
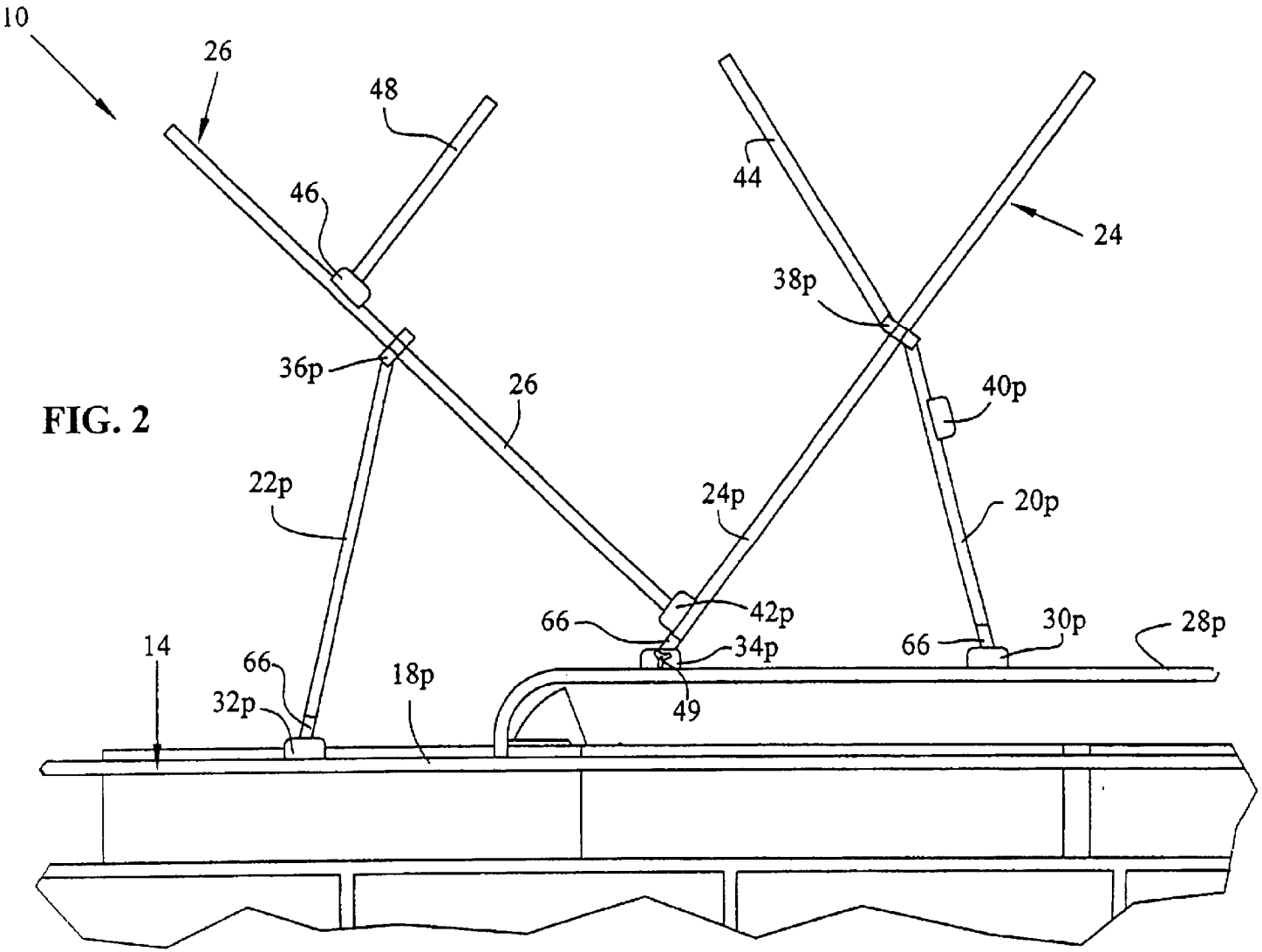
FIG. 2 is a port side view of the collapsible frame shown in FIG. 1.

Referring now to FIG. 2, a port side view of the frame 10 is now shown. The frame 10 attaches to the pontoon boat 2 on both the port side and the starboard side, but for ease of description, only the construction and attachment of the frame 10 to the port side frame of the boat 2 will be described. As would be readily apparent to one possessing ordinary skill in the art, attachment of the frame 10 to the starboard side frame rail 16 may proceed in a similar manner, and with similar components. However, to facilitate this description, while all components are identified by a reference numeral, some reference numerals include a port side (p) and a starboard side (s) designation indicating which side of boat 2 is being referred to and to which side the component is being affixed.

Referring still to FIG. 2, port side frame rail 14 is generally comprised of a first frame rail 18*p* and a raised frame rail 28*p*. The raised frame rail 28*p* may be permanently affixed to the port side frame rail 14 via any manner capable of providing support to the frame that is well known in the art.

With respect now to FIGS. 1 and 2, the components of the frame 10 will be described in greater detail. The frame 10 is comprised of a U-shaped main frame section 24 having leg portions 24*p* and 24*s*, where leg portions 24*p* and 24*s* are rotatably attached to the raised rail 28*p*, by way of a bracket 34*p*, having a threaded wheel 49. A secondary U-shaped frame 26 is rotatably fixed to main frame section 24 by bracket 42*p*. Tensioning frame members 44 and 48 are attached to frame portions 24 and 26, respectively, and are also U-shaped, as shown in FIG. 1. Frame member 44 is fixed to frame member 24 by way of double-sided bracket 38*p*, and frame member 48 is fixed by way of bracket 46. Support frame rails 20*p* and 22*p* are rotatably attached to frame rails 24*p* and 26*p*, by way of brackets 38*p* and 36*p*, respectively. The support frame members 20*p* and 22*p* are latchably attached to respective brackets 30*p* and 32*p*, by way of latch members 66, which will be more fully described herein.

Figure 3B:
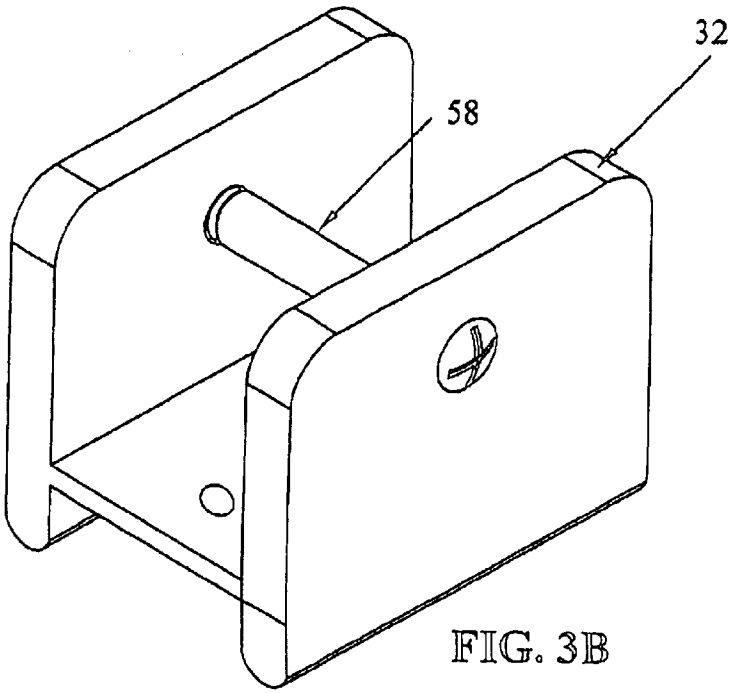
FIG. 3B is a perspective view of the bracket assembly of FIG. 3A, now in the assembled position.
Figure 3A:
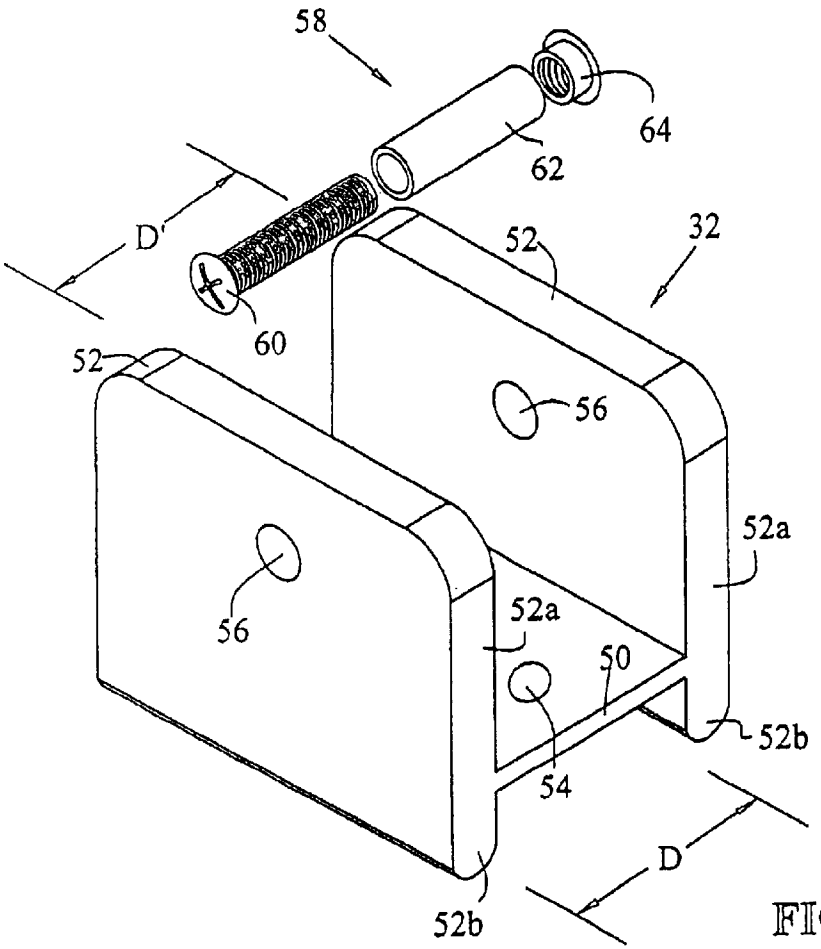
FIG. 3A is perspective view of a bracket utilized in the present invention for securing the collapsible frame to a watercraft, with the fastener assembly shown poised for receipt.

Referring now to FIGS. 2, 3A and 3B, frame bracket 32 will be described in greater detail. Two additional brackets, which are identical to that shown in FIG. 3A, are also attached to the frame 10; a rearward stern frame bracket 30*p*, and bracket 40*p* attached to support rail 20*p*. These brackets, much like their counterparts located on the starboard side, all have the same structure with the use of the different numerals being used only to indicate the relative position of the brackets on the pontoon boat 2. Therefore, with reference to FIGS. 3A and 3B, the bracket will be referred to generally by reference numeral 32, it being understood that this same structure applies to brackets 30*p* and 40*p*.

Referring first to FIG. 3A, bracket 32 includes a base 50, a pair of upright walls 52, a plurality of mounting holes 54, and a pair of bolt holes 56. The base 50 and the upright walls 52 may be comprised of aluminum, or any material having similar strength properties. Obviously, aluminum is preferred due to its light weight and resistance to corrosion. The base 50 is a planar section extending between the two parallel upright walls 52, which are arranged in a perpendicular manner such that a 90° angle is formed between each of the walls 52 and the base 50. As shown in FIG. 3A, walls 52 extend above and below base portion 50, so as to form wall portions 52A and 52B. The distance between the parallel walls 52 may vary as is necessary for the individual application. For example, the distance separating the parallel walls 52B below the base 50 is generally indicated by the letter "D." This portion of the bracket 32 generally is mounted to a portion of the boat 2 whether that portion is a raised frame, as in the present application, or a side member of the boat 2. In the preferred embodiment, the bracket 32 is mounted to the rails forming the frames 14, 16 and are therefore appropriately dimensional, as described below.

As would be obvious to one skilled in the art, this portion of the bracket should be manufactured with a distance D approximately equal to the width of the mating piece, such that the bracket securely holds onto the mating piece with lateral movement of the bracket being very limited. Likewise, the distance between the parallel walls 52A above the base 50 is indicated by D'. This portion of the bracket 50 receives various frame rails from the frame 10. As such, the upper distance D' should approximate the width of the frame rails in order to limit the lateral movement of the frame rails within the bracket, but at the same time, allow for their rotation. In the present application, all of the frame rails have substantially the same width, such that D' in all the brackets used in this embodiment is equal. Further, all the portions of the boat 18 to which the bracket 50 will be mounted are equivalent in width, meaning that the distance D for each bracket is substantially equal. Finally, preferably all frame rails used to form the frame 10, and frames 14 and 16 utilize the same rail size and therefore for all brackets 32*p*, 30*p* and 40*p*, D=D'. Consequently, the brackets used in this embodiment are universal and may be located at any one of the various positions described above.

Referring still to FIG. 3A, the mounting holes 54 allow the bracket to be affixed to either the port side frame rail 14 or the raised frame rail 28*p* via a screw or a bolt (not shown). The bolts extend first through the mounting hole and then through the rail to which the bracket 32 is being mounted, and then in the case of a bolt, the end extending through the bracket 32 and the rail is rotatably inserted into a nut (not shown) in a manner well known, so as to secure the bracket 32 to the rail. The manner of securing the bracket 32 to the frame rail 18*p*, 20*p*, 28*p*, 28*s* allows removal of the bracket 32 if desired. However, as should be apparent to one skilled in the art, if it is desired to permanently secure the bracket 32 to the frame rail 18*p*, 20*p*, 14, 28*p*, 28*s*, the bracket may be welded directly to the frame rail 18*p*, 20*p*, 14, 28*p*, 28*s*, usurping the need for a mounting bolt.

As stated above, each of the upright walls 52 includes a bolt hole 56, and the bolt holes 56 of the two upright walls 52 are located such that a longitudinal axis (not shown) parallel to the base 50 extends through the center of the bolt holes 56. This allows a bolt 58 to be inserted through the bolt holes 56 extending therebetween. The bolt 58 shown in FIG. 3A is comprised of three components: a threaded portion 60, a sleeve 62, and an internally threaded end cap 64, all manufactured from a stainless steel material or the like, in an effort to prevent oxidation of the bolt 58 as it comes into contact with water. The threaded portion 60 is substantially similar to any standard stainless steel screw having sufficient size to satisfy the needs of this application. The sleeve 62 is a hollow tube, smooth on both the inner surface and the outer surface, and having a diameter of sufficient size to allow the threaded portion 60 to be inserted therethrough. The threaded end cap 64 includes a smooth outer surface with an outer diameter approximately equal to the outer diameter of the sleeve 62, and an inner surface having threads of the same gauge as the threaded portion 60, so as to allow the threaded portion 60 to be threadably inserted into the end cap 64. Both the threaded portion 60 and the end cap 64 include a means to allow rotation, such as the familiar Phillips slot shape, which allows rotation by a standard Phillips screw driver (not shown) or a slit of sufficient size allowing receipt of a standard flat head screw driver.

In order to secure the bolt 58 to bracket 50, the sleeve 62 must first be supported between the upright walls 52, with the longitudinal axis located through the center of the bolt holes 56 traveling through the center of the sleeve 62. The threaded portion 60 may then be inserted through one of the bolt holes 56 toward the other bolt hole 56 in the opposite upright wall 52. As the sleeve 62 is aligned with the bolt holes 56, the threaded portion 60 thereby also extends through the sleeve 62. It is important to note that the threaded portion 60 has a length greater than the sleeve 62, and is profiled such that a portion of the threaded portion 60 extends at least partially into the second hole 56. The end cap 64 may then be inserted into the opposite bolt hole 56 and be rotatably affixed to the threaded portion 60, securing the bolt 58 to the bracket 50. The threaded portion 60 should be inserted into the cover portion 62 a sufficient distance so that no threads from the threaded portion 60 are visible, but rather all the threads are obscured by the sleeve 62 and the cover portion 64. The fully assembled bolt and bracket assembly 65 is shown in FIG. 3B, where a smooth surface, unimpeded by the threads is positioned and prepared for receipt of latch member 66, as described below.

While it is understood that brackets 30*p*, 32*p* and 40*p* (FIG. 2) are identical, with the exception as to their location, the brackets 34*p*, 42*p* and 46 are also similar to that shown in FIGS. 3A and 3B. In fact, the brackets 34*p*, 42*p* and 46 are identical to bracket 32 shown in FIG. 3A, with the exception that the fasteners 58 are not preassembled as shown in FIG. 3B, but rather are assembled through a frame rail, as will be described. Bracket 34*p* preferably includes a threaded hand-grip-style wheel 49.

Figure 4:
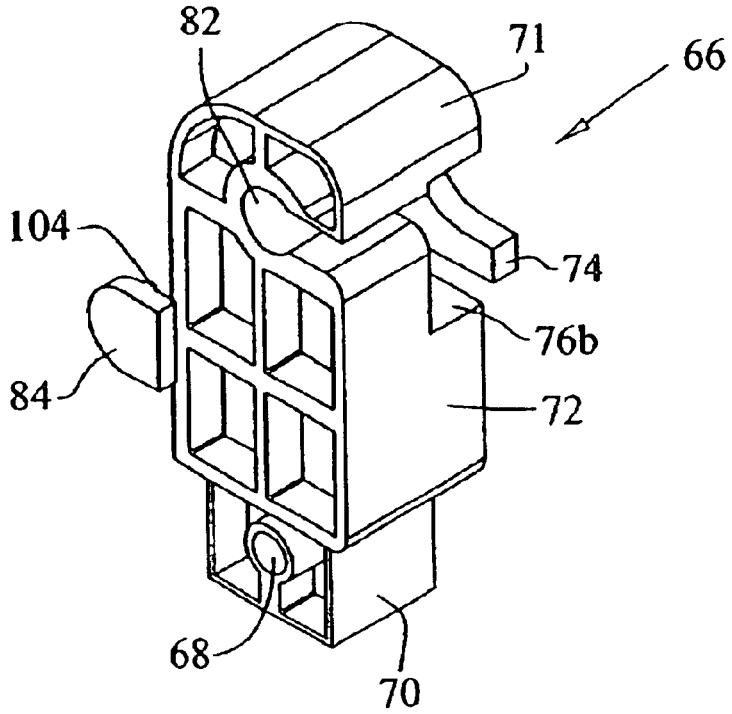
FIGS. 4 and 5 are front and rear perspective views, respectively, of the latch member of the present invention.
Figure 5:
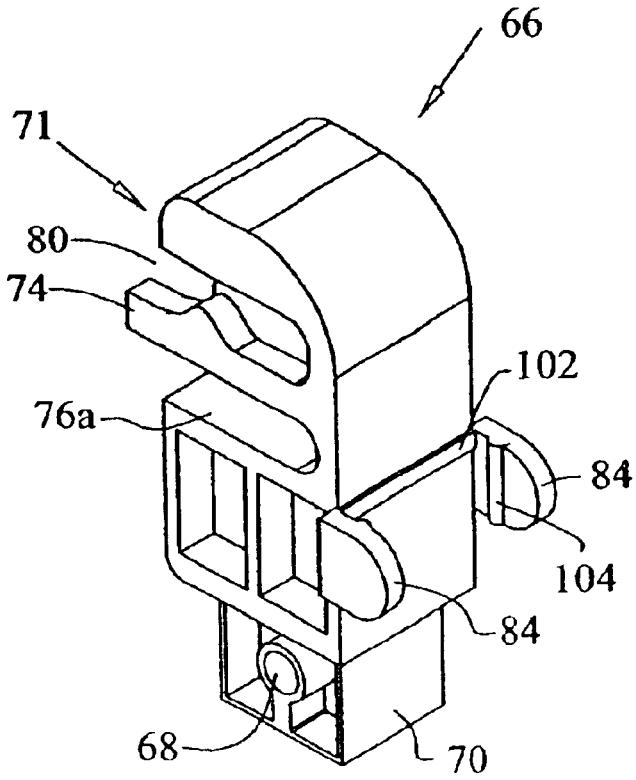
Figure 6:
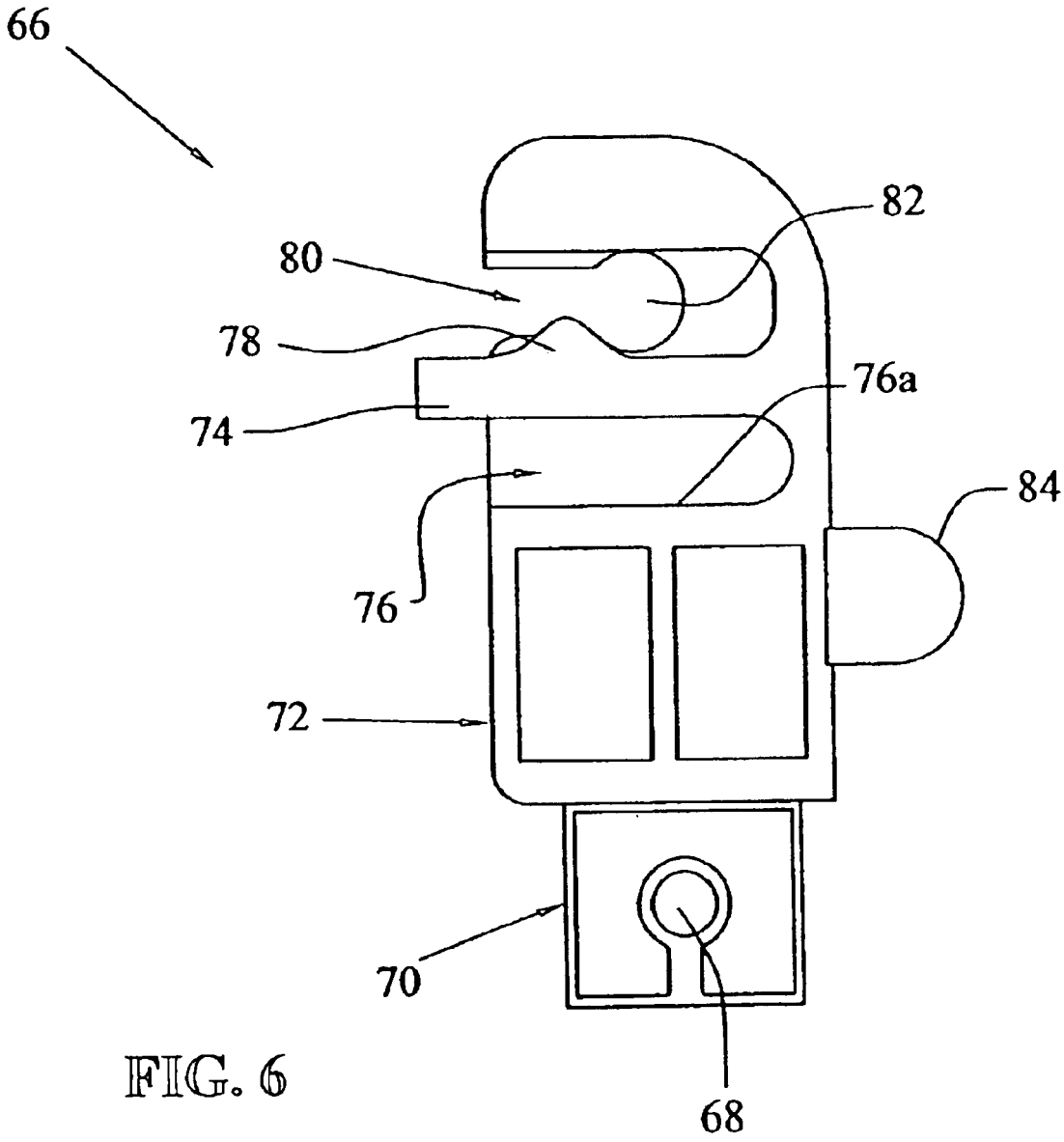
FIG. 6 is a side plan view of the latching member shown in FIGS. 4 and 5.

Referring now to FIGS. 4, 5 and 6, latching member 66 is shown in greater detail. The latching member 66 generally includes a central body portion 72, having a latch member 71 at one end and a reduced cross-section portion 70 at the opposite end. Included within the smaller area portion 70 is a bolt hole 68 used to affix latching member 66 to a frame rail in the manner described below.

The central body portion 72 of the latching member 66 generally includes a latch arm 74, a pin-receiving slot generally indicated by numeral 80, a pin-receiving area 82 and a pair of flexible wings 84. The latch arm 74 bounds the slot 80 on one side, and is flexibly movable relative to the slot by way of relief area 76. Relief area 76 substantially surrounds the latch arm, with a horizontal relief area below latch 74 at 76A, and a vertical relief area on the inner side of latch 74 at 76B. This allows latch arm 74 to move vertically upward and downward, towards and away from the slot 80. The latch arm 74 also includes a latching boss 78 located proximate pin-receiving area 82, as shown in FIG. 6. The slot 80 and the pin-receiving area 82 are both generally greater in height than the diameter of the bolt 58, with the diameter of the bolt 58 only exceeding the height of the pivot area at the apex of the boss 78. As the boss 78 gradually slopes upward near the opening 80 but has a steep decline near the pin-receiving area 82, a bolt 58 may be slidably and transversely inserted into the opening 80, biasing latch arm 74 downwardly along the boss 78 to be retained in the pin-receiving area 82, as will be more fully described below.

As shown in FIG. 5, flexible wings 84 are shown located on the back side of the latching member 66. An alignment protrusion 102 is shown, which is represented by a raised area along the smooth back side of the latching member 66, extending between the flexible wings 84. Additionally, a wing ridge 104 can be seen on the inner surface of both of the flexible wings 84. The wing ridge 104 extends vertically the length of the flexible wing 84 and has a diameter and thickness for latching to a frame rail, as will be described herein.

Figure 7:
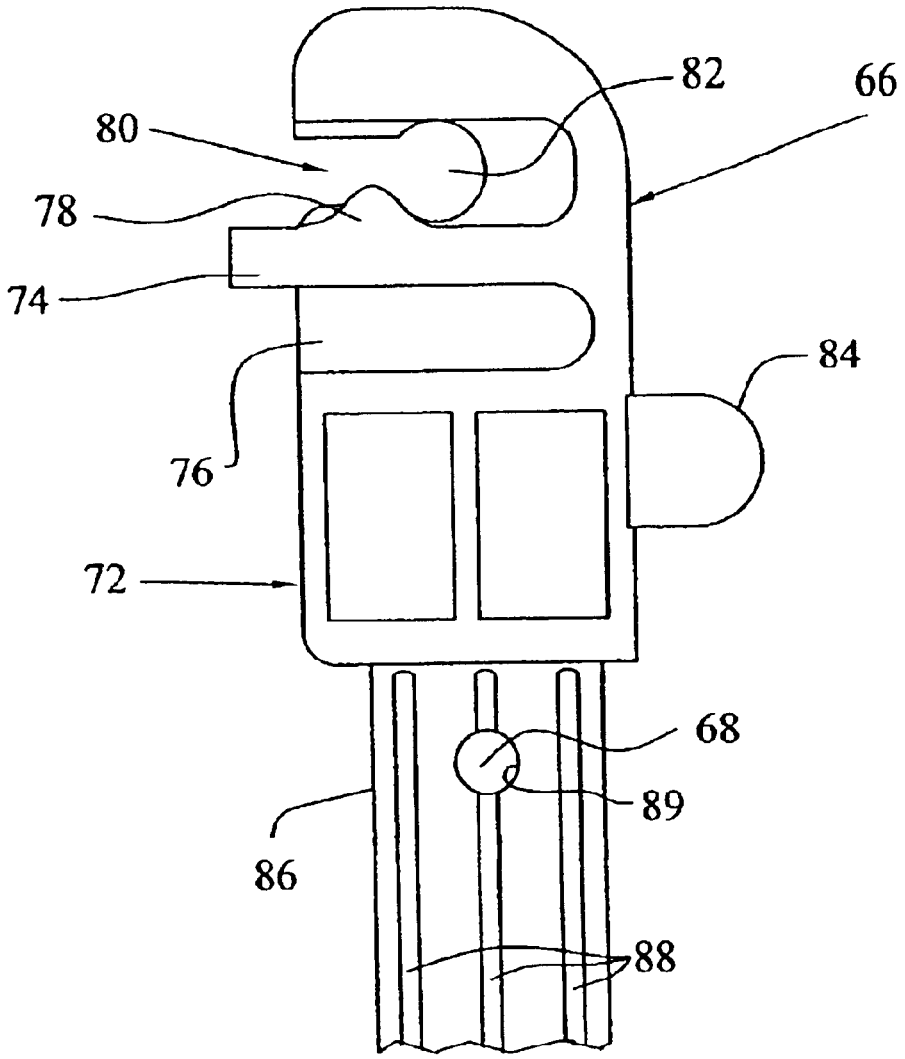
FIG. 7 is similar to FIG. 6, with the latching member inserted and attached to a frame member of the collapsible frame.

Referring now specifically to FIG. 7, the latching member 66 is shown being affixed to frame member 86. The frame member 86 represents any of the frame rails found in frame 10, for example, the stern frame 20*p*, the stern frame member 24*p*, and the bow support frame 22*p*, along with the corresponding members on the starboard side. As shown in FIG. 7, all frame members 86 utilized in frame 10 are preferably extruded aluminum so as to have a rectangular hollow core and a plurality of evenly spaced grooves 88. In this embodiment, three grooves 88 of identical depth and thickness are spaced throughout the frame member 86.

Referring again both to FIGS. 6 and 7, the reduced cross-sectional area portion 70 is seen to have a substantially rectangular cross-section, which is complementary to the frame member 86, such that portion 70 of the latching member 66 may be inserted into the frame member 86 without the need for great force, as would be required in an interference fit. However, the cross-sectional area should be close enough in size so that the latching member 66 is held firmly enough by frame member 86 so as to ensure the latching member 66 does not wobble or rotate within the frame member 86. The latching member 66 is held affixed within the frame member 86 by a bolt (not shown) which travels through the bolt hole 89 of frame member 86 and throughhole 68 of the latching member 66. The bolt used in this application may be any well known in the art, and need not be the bolt 58 disclosed herein.

Figure 8:
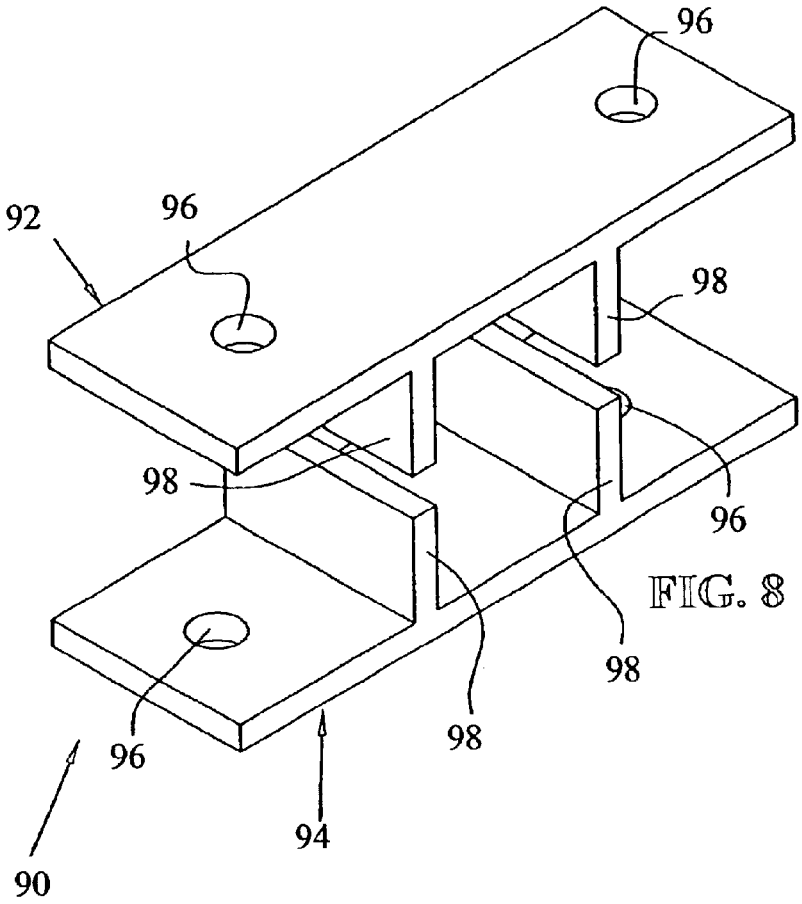
FIG. 8 is a perspective view of a clamping bracket utilized in the present invention.
Figure 9:
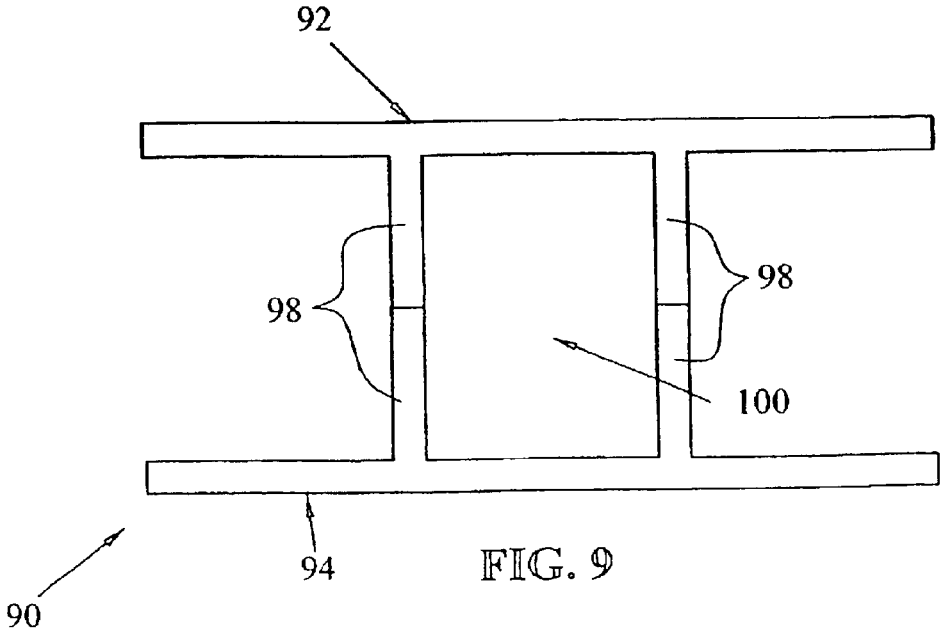
FIG. 9 is a side view of the clamping bracket shown in FIG. 8.
Figure 11:
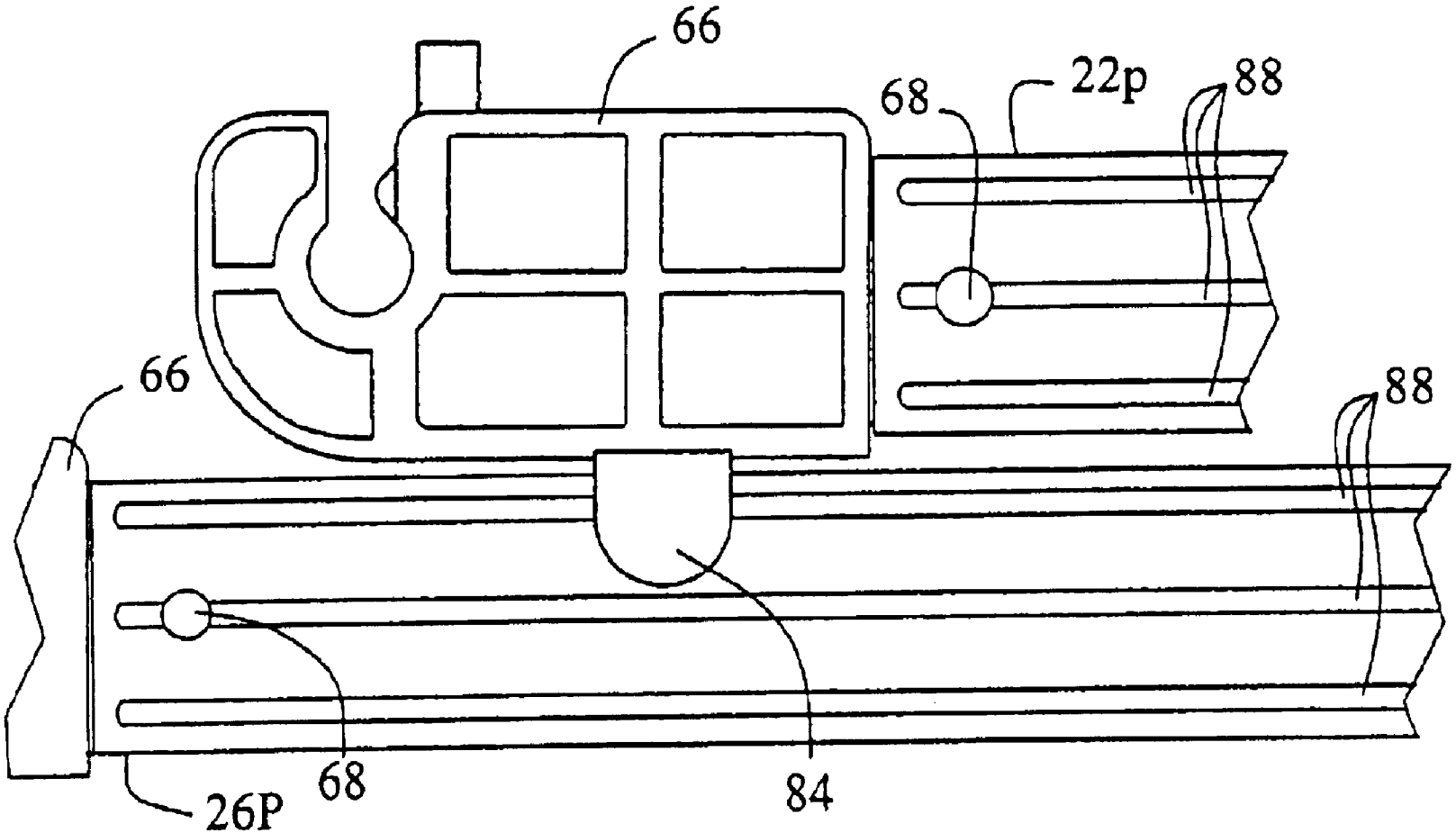
FIG. 11 is a side plan view showing the interaction of the latch member with another frame member.

Referring now to both FIGS. 8 and 9, a clamping bracket 36 is shown, and as stated above, the clamping bracket 36 shown in these figures may function as both the bow clamping bracket 36*p* and the stern clamping bracket 38*p* (FIG. 2), with the differences in numbers serving only to differentiate location. The clamping bracket 90 includes an upper bracket portion 92 and a lower bracket portion 94. Both the upper bracket portion 92 and the lower bracket portion 94 include a plurality of bracket bolt holes 96 and a pair of inner walls 98. As can be seen in FIG. 8, there are two bracket bolt holes 96 located in each bracket portion 92, 94. The bracket bolt holes 96 are located outside the inner walls 98 with respect to the center of the bracket portions. The bracket bolt holes 96 on both the upper bracket portion 92 and the lower bracket portion 94 are properly orientated when the inner walls 98 of the bracket portions 92, 94 are aligned. This allows a bolt (not shown) to be inserted through the bracket bolt holes retaining the bracket portions 92, 94 together. As shown in FIG. 11, when the bracket portions 92, 94 are clamped together with the shoulders 98 properly aligned, a channel, generally indicated by numeral 100, is located between the central areas of both the upper bracket portion 92 and the lower bracket portion 94 and the plurality of shoulders 98 included therein. Generally, this channel 100 is of sufficient size to form an interference fit with any of the frame rails employed in frame 10, as will be described below.

With all of the components of the assembly described, the construction for the entire frame 10 will now be described. Referring first to FIG. 2, the main frame rail 24 (or stern frame rail) is mounted to the upper rail 28*p* by way of a bracket 34*p*. It should be appreciated that a bracket (such as 32 shown in FIG. 3A) may be mounted to rail 28*p* by way of two bolts through apertures 54. Rail 24 is then mounted to bracket 34*p* by way of fasteners through apertures 56, together with a threaded portion, such as threaded wheel 49. Thereafter, the bow frame member 26 is rotatably attached to an angle support bracket 42*p* via a fastener through bolt hole (not shown) in bow frame member 26. The angle support bracket 42*p* is mounted to stem frame member 24 in much the same manner that the frame bracket 34*p* is mounted to the port side raised frame rail 28*p* with a plurality of bolts through the base (not shown) of the support bracket 42*p*. As the bow frame member 26 is affixed to the angle support bracket 42*p* via a fastener through a bolt hole, the bow frame member 26 is fixed to, and may pivot about, bracket 42*p*.

As shown in FIG. 2, the bow frame member 26 extends through the channel 100 (FIG. 9) of the bow clamping bracket 36*p*. As described above, bolts extend through the bracket bolt holes 96 (FIGS. 8, 9) and create a clamping force upon the bow frame member 26, thereby securing the position of the bow clamping bracket 36*p* upon the bow frame member 26. In the preferred embodiment, one of the fastener pairs for the clamp member will include a threaded wheel like 49, in order to easily adjust the clamp longitudinal position relative to frame 26. Additionally, bracket 36*p* attaches an end of support frame portion 22*p* thereto, such that it extends toward the deck of the pontoon boat 2 from the bow clamping bracket 36*p*. One of the latching members 66 is mounted to the opposite end of frame rail 22*p*, as described with reference to FIG. 7, and is latched to bracket 32*p*, as will be further described herein.

A cover support bracket 46 is also attached to bow frame member 26. Cover support bracket 46 consists of the same structure as the bracket disclosed in FIG. 3A and will be affixed to bow frame member 26 in a manner consistent with that described above. Cover support frame 48 is located between upright walls 52 and retained therein via a bolt (not shown) so as to angularly extend therefrom toward the stern of the boat 18. As should be readily apparent to one possessing ordinary skill in the art, the height by which cover support frame 48 extends over the deck of pontoon boat 18 should be approximately equal to the height of bow frame member 26, stern frame member 24, and stern cover frame 44, in order to ensure the cover (not shown) remains substantially parallel to the deck when arranged in the open position.

A stem clamping bracket 38*p* is attached to the frame portion 24*p* of the stern frame member 24, in much the same manner as bow clamping bracket 36*p* is attached to the bow frame member 26. A stern cover frame 44 is bolted to one side of the stern clamping bracket 38*p*, and extends upwards therefrom. The stern cover frame 44 extends from the stern clamping bracket 38P angularly upwards and toward the bow of the boat 18 until reaching the approximate height of the stern frame member 24, whereupon the stern cover frame 44 mimics the profile of the stern frame member 24, as shown in FIG. 2. Much like the stern frame member 24, the stern cover frame 44 mirrors itself at the midpoint between the port frame rail 14 and starboard frame rail 16 sides of the pontoon boat 18. However, unlike the stern frame member 24, the stern cover frame 44 is able to pivot within the stern clamping bracket 38, as it is mounted via a bolt 58 through the bolt hole (not shown), whereas the stern frame member 24 is clamped within the stern clamping bracket 38.

The stern support frame 20*p* extends from the stern clamping bracket 38*p* opposite the stern cover frame 44. The stern support frame 20*p* is connected to the stern clamping bracket 38*p* in a manner similar to the connection between the stern clamping bracket 38*p* and the stern cover frame 44, described above, allowing the stern support frame 20*p* to pivot around the clamping bracket 38*p*. Opposite this connection, the stern support frame 20*p* includes a latching member 66 fixed to the end of frame 20, as described with relation to FIG. 7. Finally, a storage support bracket, identical to that shown in FIG. 3A is mounted to frame rail 20*p*, as will be described herein, which is snapped to the stem frame bracket 30*p* in a manner as described below.

With frame 10 as assembled above, the operation of the device will now be described. Prior to describing the entire operation of the frame, certain features of the frame components will be described, as these components are used in multiple places, namely, latching member 66, as it latches and unlatches to bolt 58, together with the latching feature of the wings 84 to a frame member.

Figure 10A:
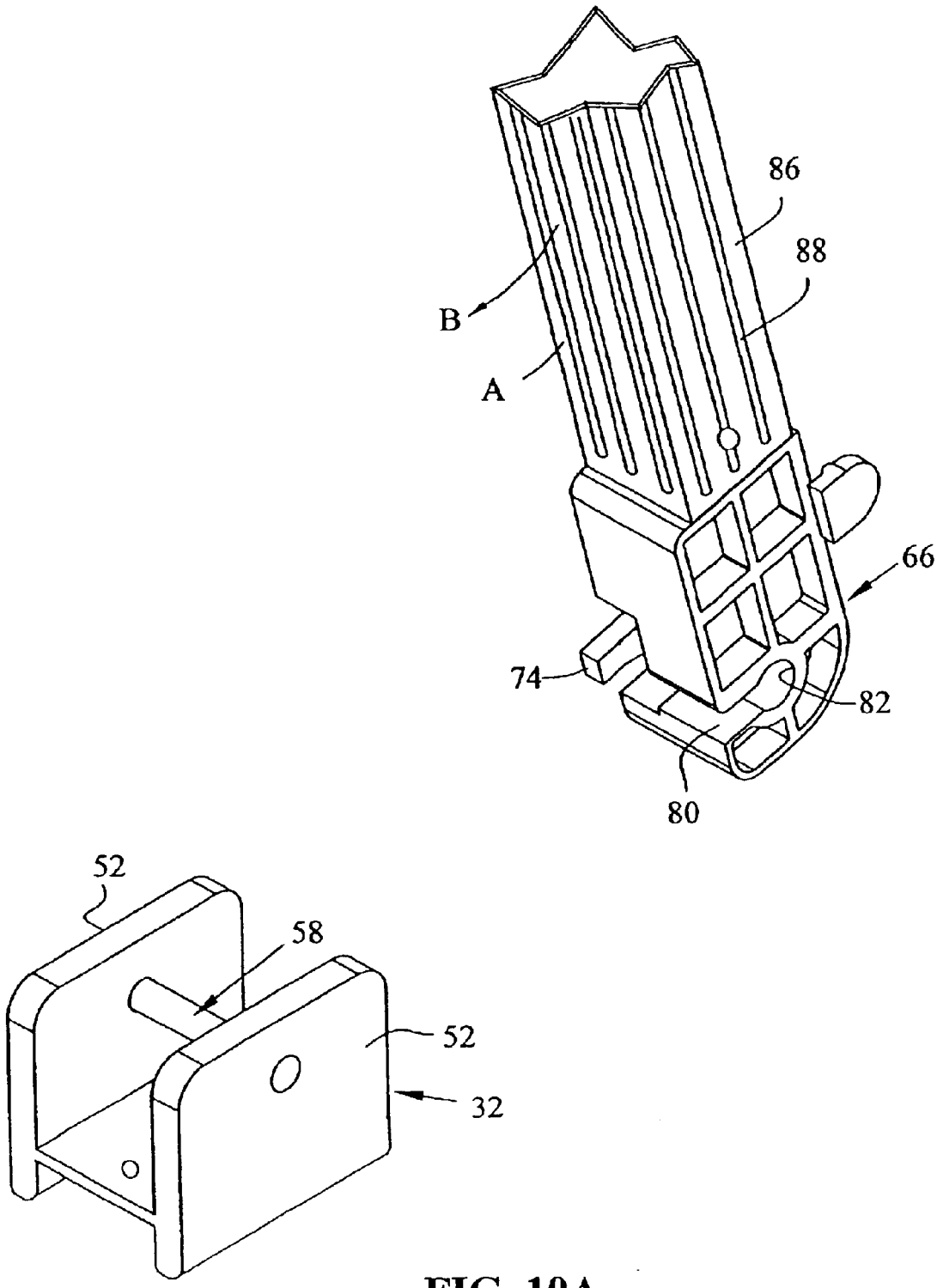
FIGS. 10A and 10B show perspective views of the interaction between the latch member and bracket assembly.

With reference first to FIG. 10A, the latching of latch member 66 into bracket 32, and to bolt assembly 58 will be described. As it should be appreciated from the description of the latch member 66, latch member 66 includes a transverse slot at 80, and the latch member 66 is mounted relative to its associated frame member 86 so as to face the bolt assembly as shown in FIG. 10A. It should be appreciated that the width of latch member 66 is sized less than D', as described with reference to FIG. 3A, so as to be slidably received between side walls 52 of the bracket 32. It should be appreciated that the slot member 80 will be received partially over the bolt, until it meets resistance with latching boss 78 (FIG. 6). At this point, the user can simply grasp the frame 86 at approximately location A, and pull frame member 86 in the clockwise rotation shown at B. This pulling force at point A causes latch arm 74 to resiliently bias upwardly such that bolt assembly 58 may be received and retained in opening 82. Once received in opening 82, bolt 58 is on the rearward or declining side of latch boss 78, and is retained therein until a like force in the opposite direction is produced, as described below.

Figure 10B:
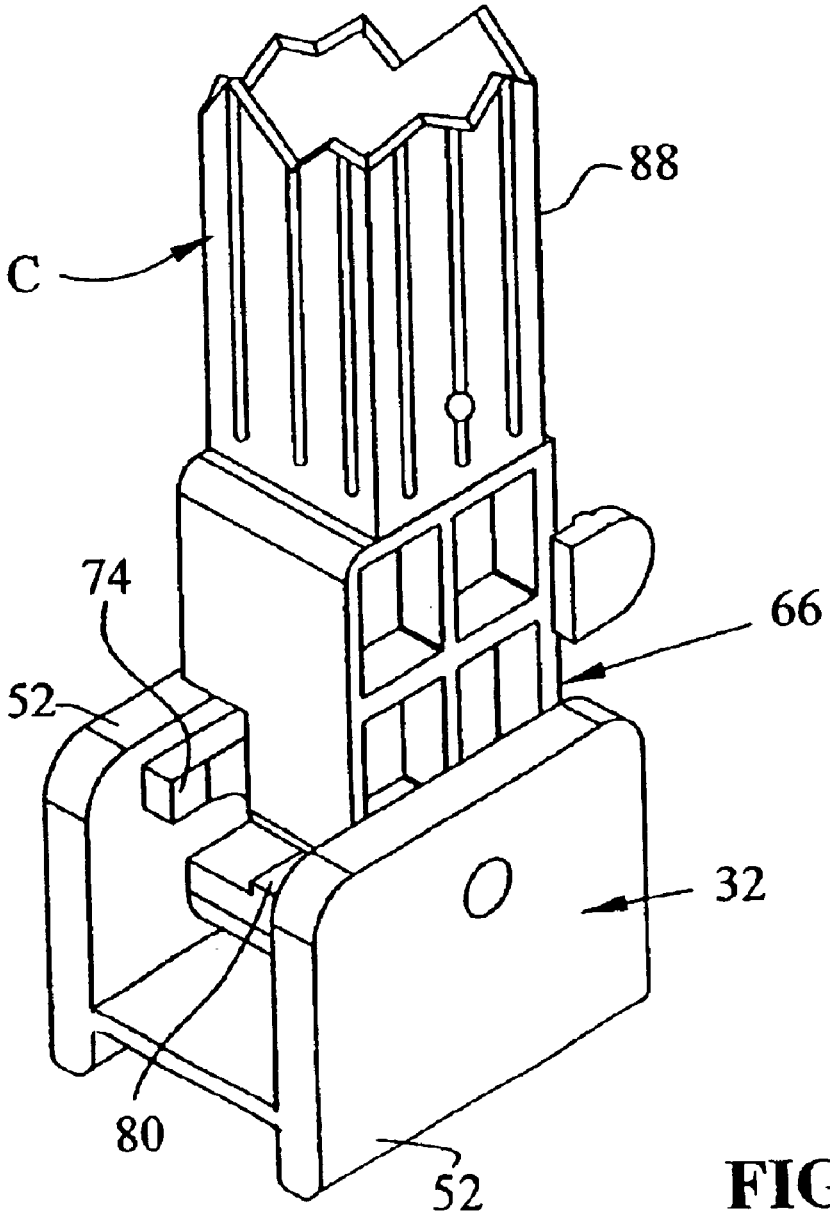

Separation of the latching member 66 from the bolt 58 is achieved by an application of force in the opposite direction, for example, in direction C, as shown in FIG. 10B. As should be appreciated from those skilled in the art, this force is typically applied by the palm of one's hand at about point A. As should be appreciated, this force causes the latching boss to contact the bolt, on the rear side of the latching boss, causing the latch 74 to resiliently bias upward and thereby release bolt 58 through slot 80.

Referring next to FIG. 11, the latching member 66 of the bow support frame 22*p* is shown attached to the bow frame member 26. It should be appreciated that, while the interconnection described will be specific to the latching of frame 22*p* to 26*p*, the identical connection takes place between 20*p* and 24*p* (FIG. 2). As shown in FIG. 11, the bow frame member 26*p* and the bow support frame 22*p* each include three evenly spaced grooves 88, as described above. Grooves 88 are preferably present in all of the aluminum frame rails utilized in the frame 10 so that any latching member 66 may be affixed to any rail in the manner described herein. Referring both to FIGS. 5 and 11, the latching member 66 of bow support frame 22 attaches to the bow frame member 26, when wings 84 flank frame 26*p*, and are positioned such that the wing ridges 104 (FIG. 5), located on the inside of the flexible wing 84, snap into the grooves 88 (FIG. 11). This provides a gripping action by the latching member 66, whereby it is affixed to the bow frame member 26*p*.

Additionally, the distance from the apex of the alignment protrusion 102 to the center of the wing ridge 104 should roughly approximate the distance from the edge of a frame rail to the center of any groove 88 for any component frame rail utilized in the frame 10. This allows the latching member 66 to be attached to any component frame rail of the frame 10 by simply pressing the back side of the latching member 66 onto any frame rail. When the wing ridges 104 come into contact with the frame rail, flexible wings 84 will flex slightly outward such that the wing ridges 104 ride against the outer surface of the frame rail. However, once the latching member 66 has been pushed onto the frame rail a sufficient distance such that the alignment protrusion 102 is now in contact with the frame rail, the wing ridges 104 should enter the grooves 88 of the frame rail with the flexible wings 84 flexing back to their standard position, and thereby allowing the latching member 66 to be grippably attached to the frame rail. Further, as the frame rail is now in contact with the alignment protrusion 102, no other portion of the latching member 66, aside from the flexible wings 84 and the wing ridges 104, should be in contact with the frame rail. Likewise, any frame rail attached to the latching member 66 via a bolt through the bolt hole 68 will also be separated from the opposing frame rail by a distance approximately equal to the height of the alignment protrusion 102.

Figure 12A:
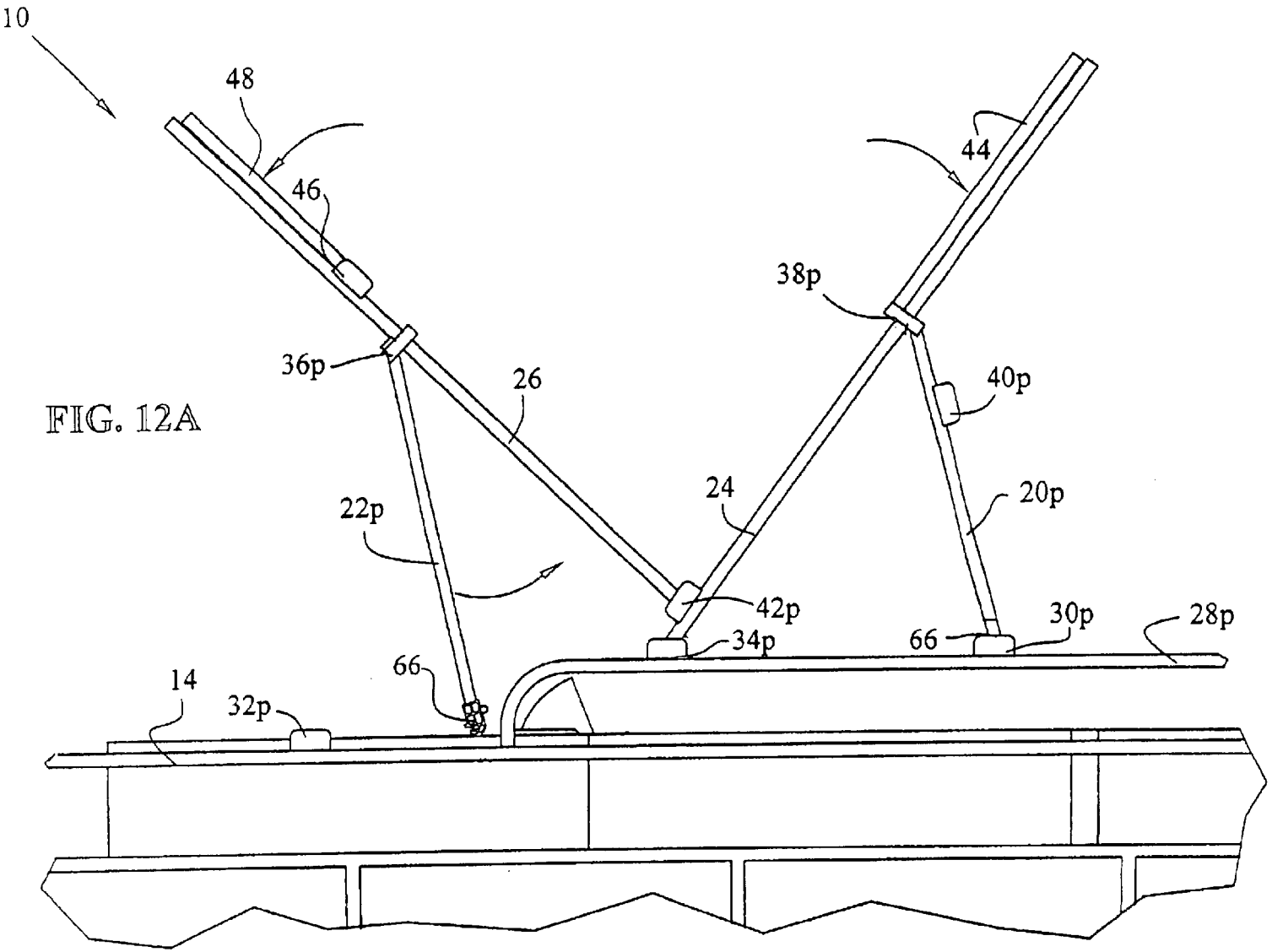
FIGS. 12A–12E are side views of the collapsible frame in progressive sequence.
Figure 12B:
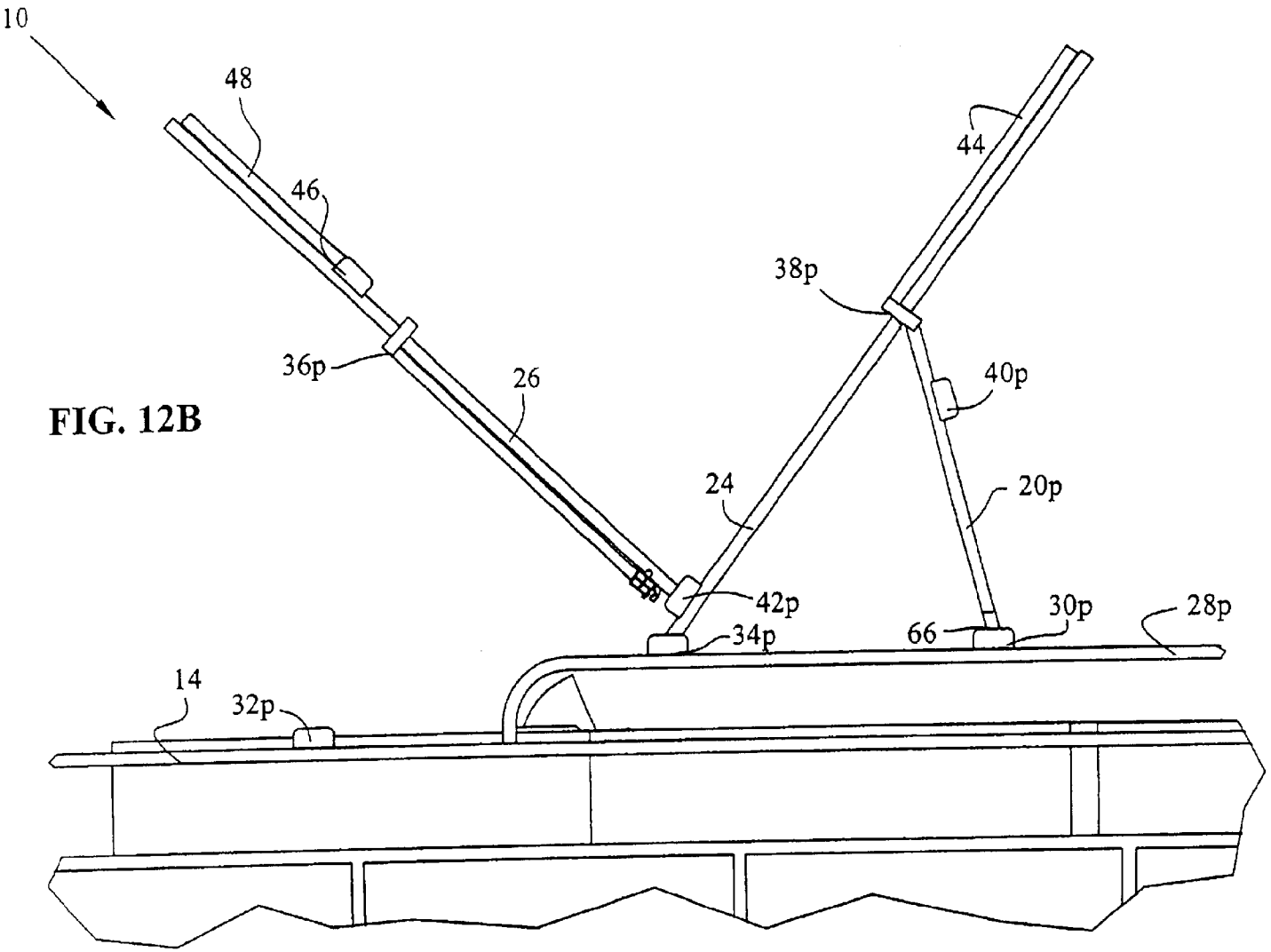
Figure 12C:
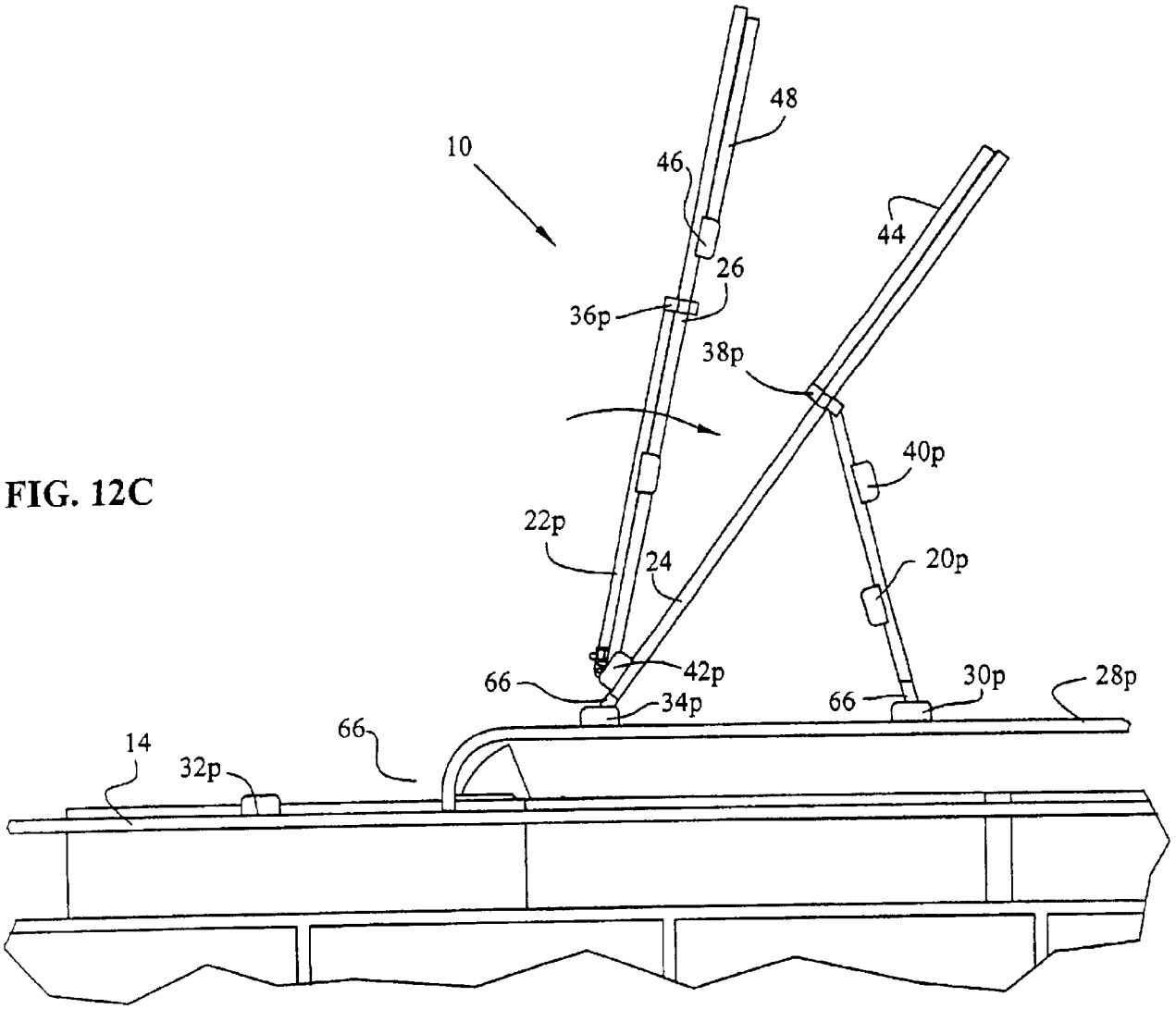
Figure 12D:
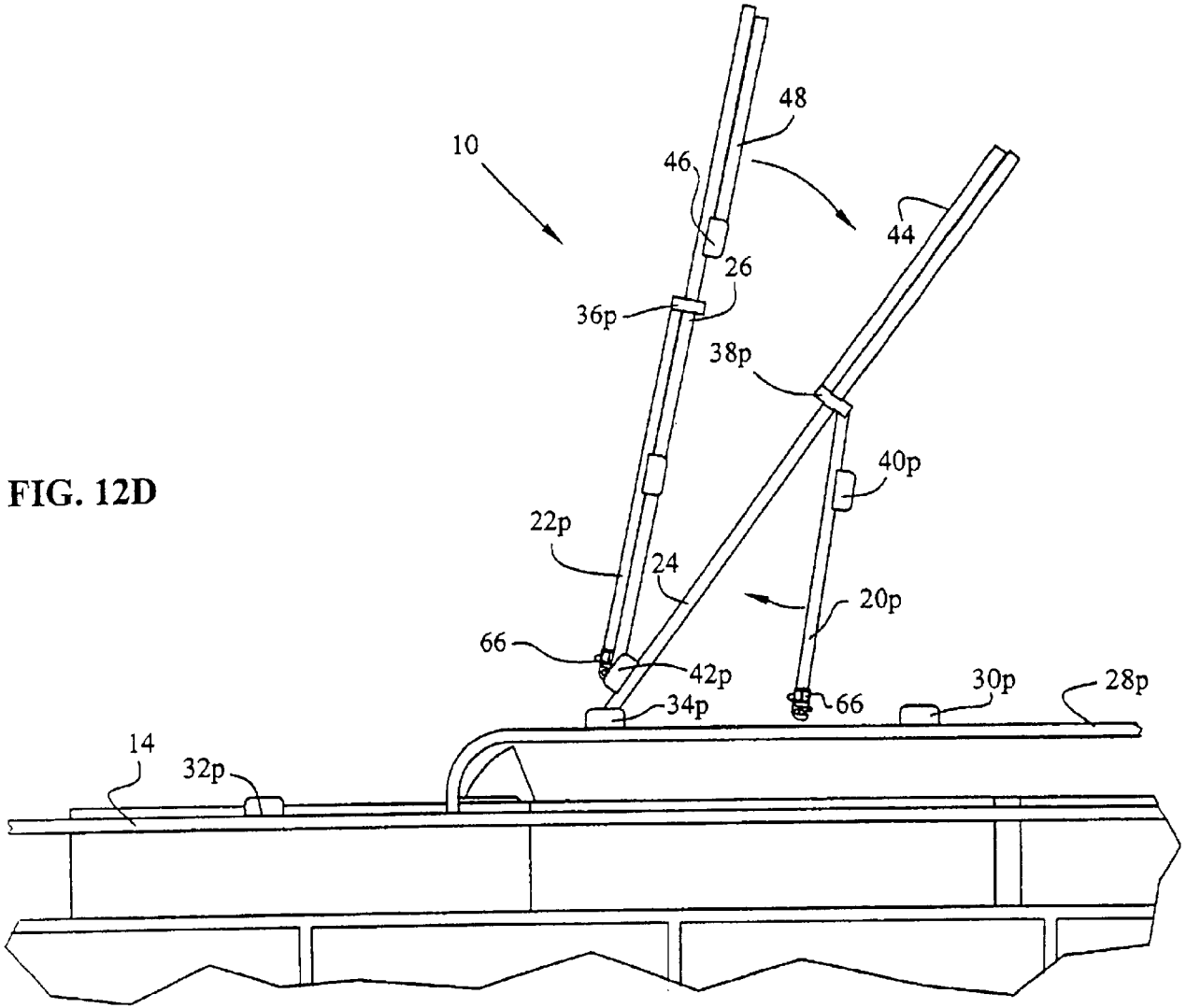
Figure 12E:
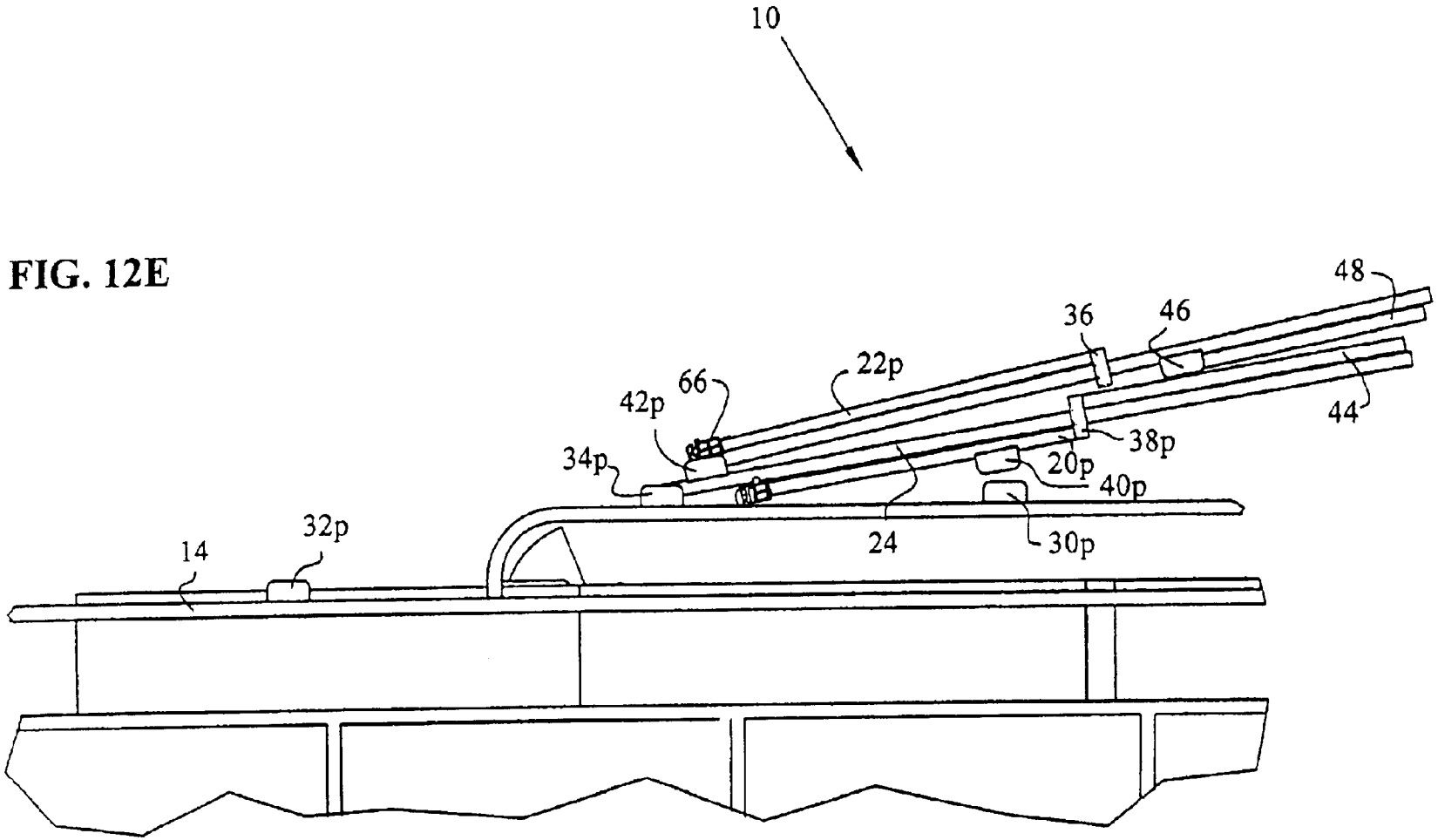

With the function of all of the components as described above, the operation of the entire frame 10 will now be described in relation to FIGS. 12A–12E. With reference first to FIG. 12A, the initial stowing operation of the frame 10 has begun, where frame rail 48 has been rotated in the counter-clockwise position as viewed, from its initial position of FIG. 2; and frame rail 44 has been rotated clockwise as viewed in FIG. 12A from its initial position as shown in FIG. 2. Support rail 22*p* is also shown where latch 66 has been removed from bracket 32*p*, and support rail 22*p* has been rotated towards frame rail 26. Latch member 66 can now be snapped into place against frame rail 26, as described with relation to FIG. 11, and as shown in FIG. 12B. As shown in FIG. 12C, frame rails 26, 48 and support rail 22*p* can now be rotated as one, in the clockwise position as shown towards frame rail 24. Connector 66 at the end of frame rail 20*p* may now be removed from its associated bracket 30*p* by a force on frame rail 20*p*, in the clockwise direction, and may be rotated as shown in FIG. 12D towards frame rail 24. Frame rail 20*p* may now be latched to frame rail 24 by way of wings 84 latching to grooves 88 on frame rail 24, again much like that described with reference to FIG. 11 above. Referring now to FIG. 12E, the frame 10 is shown in the storage position. This position is generally utilized during the normal operation of the pontoon boat 18, when the user does not desire the protection provided by the cover 12. In this configuration, the frame 10 is stable, allowing the user to operate the pontoon boat 18 in a normal manner. In the position shown in FIG. 12E, the stowed or collapsed frame 10 will normally rest upon the rear seats, or on the rear deck area, of the boat 2. The conversion from the frame 10 shown in FIG. 12E to the assembled frame 10 shown in FIG. 2 is accomplished in the opposite sequence to that just described.

Figure 13:
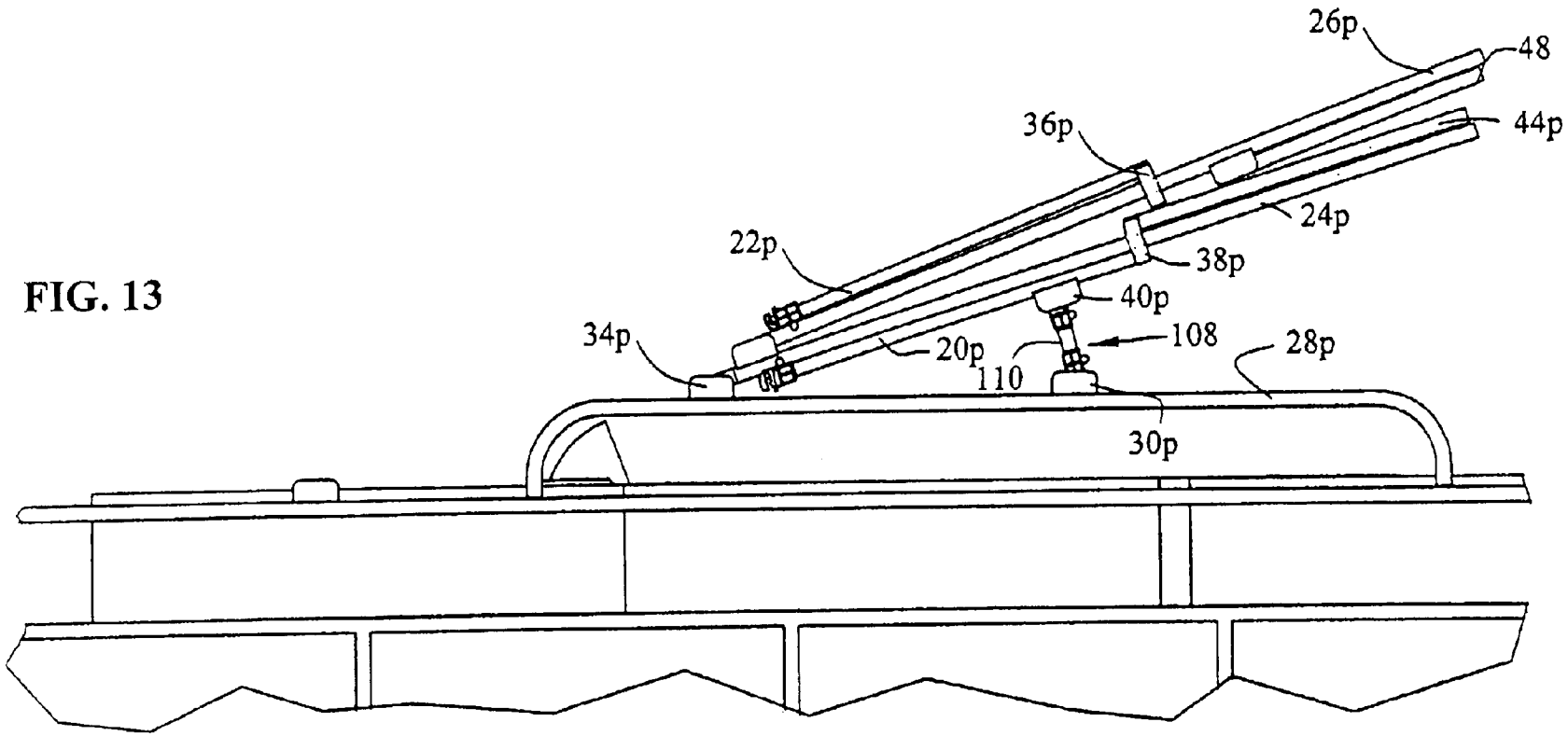
FIG. 13 is a side view of the collapsible frame shown in FIG. 2 arranged in a travel position by way of a travel rail.

Referring now to FIG. 13, a travel or towable position of the frame 10, or an alternative position to that of FIG. 12E, is shown. This position is most desirable when the pontoon boat 18 is traveling on land, while being trailered (not shown). Generally, while resting on a trailer, the pontoon boat 18 extends a distance above the ground, such that frame 10, if erect, could potentially become entangled with low tree branches or could be damaged due to the wind resistance. Prior art solutions to this issue have involved removing the equivalent of the stern support frame 20, thereby causing the frame 10 to rest directly upon the port side frame rail 14 and the starboard side frame rail 16. This is undesirable, however, as bumps in the road may cause the frame 10 to raise above the port side frame rail 14 and the starboard side frame rail 16 and come crashing down, thereby possibly damaging the frame rails 14, 16 and the frame 10. In order to achieve a travel position which does not damage the frame rails 14, 16 but also maintains the frame height at a safe level, a travel support member 108 is affixed between the storage support bracket 40*p* and the stern frame bracket 30*p*, the stern frame bracket 30 being unoccupied due to the position of frame 20*p* (FIG. 13).

Figure 14A:
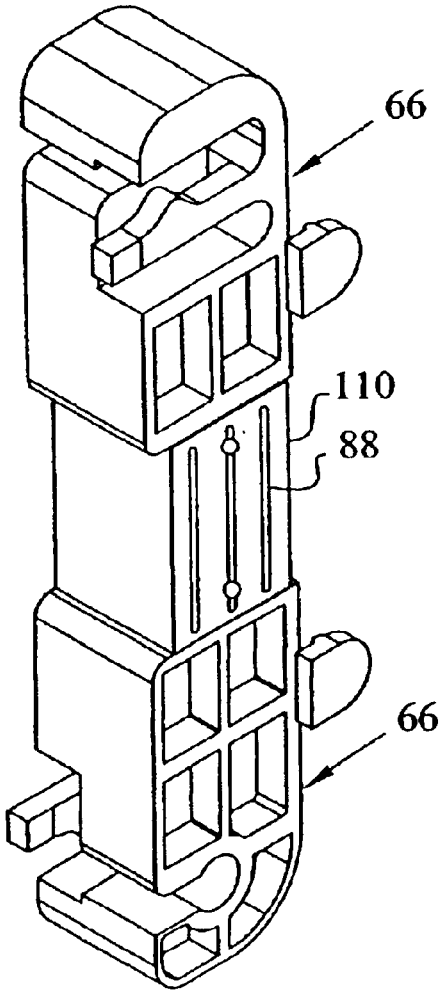
FIGS. 14A and 14B show perspective views of the travel rail of FIG. 13 utilized to retain the frame in the travel position.
Figure 14B:
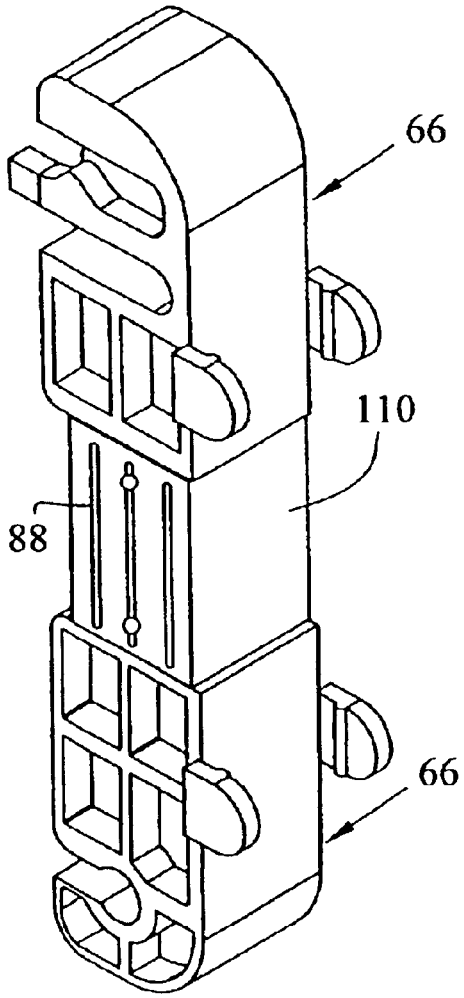

The travel support 108 is shown in both FIGS. 14A and 14B, and is comprised of a rail 110 manufactured from aluminum or any other like material and has a plurality of grooves 88 in the manner equivalent to the rest of the rails included in frame 10. Attached to each open end of the rail 110 is a latching member 66, affixed in the typical manner described above. As shown, the connectors are preferably mounted such that the slots 80 extend in the same direction, which reasons will become apparent from the description below.

In order to place the frame into the travel position from the storage position from FIG. 12E to FIG. 13, the travel support 108 is simply positioned intermediate the two brackets 30*p*, 40*p*. As both of the brackets are identical to that shown in FIG. 3B, that is, both include bolt assembly 58, the connectors 66 of support 108 are simply snapped in place. As the travel support 108 has a length substantially less than the stern support frame 20, the frame 10 has a reduced height in reference to the pontoon boat 18 as compared to the height when the frame 10 is placed in the upright position, which prevents the frame from contacting any low-lying articles, yet at the same time supports the frame above the boat 2, preventing marring the boat.

When the frame 10 is not in the travel position, the latching members 66 included in the travel support 108 allow the travel support 108 to be stored on any frame rail of the frame 10 via the flexible wings 84 and the wing ridges 104. However, if desired, the user may also store the travel support 108 in a separate location, as it is not permanently affixed to the frame 10. It should be appreciated that two travel supports would be preferable, one for the port side and one for the starboard side of the boat 2.

While this invention has been described as having an exemplary design, the present invention may be further modified within the spirit and scope of this disclosure. The application is, therefore, intended to cover any variations, uses, or adaptations of the invention using its general principles. Further, this application is intended to cover such departures from the present disclosure as come within known or customary practice in the art to which this invention pertains.

What we claim is:

1. A latching member for latching a first frame rail of a collapsible boat frame to a second frame rail of said collapsible boat frame, said latching member being affixed to said first frame rail and comprising a pair of flexible members at least one including a ridge, said second frame rail including at least one groove, wherein said one ridge may be inserted into said groove to retain said latching member to said second frame rail thereby retaining said first frame rail to said second frame rail.

2. The latching member set forth in claim 1, wherein the other of said pair of flexible members includes a ridge and said second rail includes a second groove being located opposite said first groove, said latching member being affixed to said second frame rail upon insertion of said ridges into said first groove and said second groove.

3. The latching member set forth in claim 2, further including a protrusion wherein only said protrusion, said flexible wings, and said ridges are in contact with said second frame rail when said latching member is affixed thereto, said protrusion preventing contact between said first frame rail and said second frame rail.

4. The latching member set forth in claim 3, further including a pivot area having an opening including a retaining ridge;

a release arm; and a cavity located adjacent to said release arm, said cavity being located opposite said opening wherein a force may be exerted upon said release arm moving said retaining ridge into said cavity allowing a bolt retained within said pivot area to exit through said opening.

5. The latching member set forth in claim 4, wherein said retaining ridge maintains a gradient toward said opening and a drop-off toward said pivot area allowing said bolt to cause said retaining ridge to move toward said cavity when being inserted toward said pivot area with said drop-off retaining said bolt within said pivot area unless said release arm is depressed toward said cavity.

6. The latching member set forth in claim 5, including a larger area portion supporting said flexible members wherein said flexible members are parallel when extending away from said larger area portion.

7. The latching member set forth in claim 6, including a smaller area portion having an aperture, said smaller area portion being insertable into said first frame rail, a retaining bolt extending through said first frame rail and said aperture of said latching member, affixing said first frame rail thereto.

8. The latching member set forth in claim 7, wherein said second frame rail includes a plurality of opposing grooves allowing a second latching member to be affixed thereto by way of a pair of ridges.

9. The latching member set forth in claim 7, wherein said first frame rail includes a plurality of grooves allowing a second latching member to be affixed thereto by way of a pair of ridges.

* * * * *